US006302606B1

(12) United States Patent
Hayakawa et al.

(10) Patent No.: US 6,302,606 B1
(45) Date of Patent: Oct. 16, 2001

(54) SHEET RECEIVING/STACKING DEVICE, AND IMAGE FORMING APPARATUS HAVING THE SAME

(75) Inventors: Yasuyoshi Hayakawa; Teruo Komatsu; Tsuyoshi Waragai, all of Mishima; Tomoyuki Araki, Numazu; Atsushi Ogata; Masayoshi Fukatsu, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/487,607

(22) Filed: Jan. 19, 2000

(30) Foreign Application Priority Data

Jan. 20, 1999 (JP) ..... 11-012152

(51) Int. Cl.[7] ..... B41J 11/58; B65H 31/04

(52) U.S. Cl. ..... 400/625; 271/213; 271/220; 271/157

(58) Field of Search ..... 400/625, 642, 400/645, 647.1; 101/235–241; 271/213, 214, 220, 207; 414/790.7, 789.9

(56) References Cited

U.S. PATENT DOCUMENTS 4,043,458 * 8/1977 Schott, Jr. ..... 271/213
4,794,859 * 1/1989 Huseby ..... 271/213
4,883,265 * 11/1989 Iida et al. ..... 271/220
5,155,537 10/1992 Komatsu et al. ..... 355/309
5,292,116 3/1994 Inoue et al. ..... 271/157
5,324,020 * 6/1994 Rasmussen et al. ..... 271/213
5,348,284 9/1994 Ishihama et al. ..... 271/160
5,372,360 * 12/1994 Ricciardi ..... 271/213
5,451,044 * 9/1995 Nakayama ..... 271/220
5,501,444 3/1996 Yukimachi et al. ..... 271/127
5,651,540 7/1997 Watanabe et al. ..... 271/10.12
5,769,413 * 6/1998 Hummel et al. ..... 271/213
5,921,690 * 7/1999 Shinmachi et al. ..... 400/625
6,092,948 * 7/2000 Altfather ..... 400/625
6,190,116 * 2/2001 Asada ..... 414/790.7

* cited by examiner

*Primary Examiner*—Eugene Eickholt
(74) *Attorney, Agent, or Firm*—Fitzpatrick, Cella, Harper & Scinto

(57) ABSTRACT

A sheet receiving/stacking device, which has a sheet stacking portion for stacking sheets, a sheet conveying portion for conveying sheets to the sheet stacking portion, and a retractable sheet guiding portion for catching the bottom surface of a sheet and then guiding the sheet to the sheet stacking portion. The sheet guiding portion is moveable between a guide position and a retracted position.

21 Claims, 11 Drawing Sheets

SHEET RECEIVING/STACKING DEVICE, AND IMAGE FORMING APPARATUS HAVING THE SAME

BACKGROUND OF THE INVENTION

1. Field of the Invention

The present invention relates to a sheet receiving/stacking device for receiving and stacking sheets in a sheet stacker, and to an image forming apparatus having this sheet receiving/stacking device.

2. Description of the Related Art

Sheet discharging/stacking devices incorporating binding devices, such as staplers, for use in a printer and other image forming apparatus, are well known. Also well known is the type of sheet discharging stacker provided on a side surface of the printer near the discharge opening of the printer body and adapted to bind printed sheets corresponding to each job and to then discharge and stack the bound sheets.

The image forming apparatus is, for example, a copier, a printer, a facsimile machine, or a composite apparatus thereof. Furthermore, the sheet is, for example, a plain paper sheet, a thin resin sheet which serves as a substitute for the plain paper sheet, a postcard, a cardboard sheet, a letter sheet, and a thin plastic plate.

Usually, printers discharge sheets, printed side up. To receive and stack printed sheets in proper page order and to then bind such stacked sheets, the sheet discharging stacker of this type has a sheet reversing mechanism for reversing sheets so that the sheets each having the printed side face down are stacked in the page order, binding devices for stacking the printed sheets corresponding to each job and for aligning and binding the stacked sheets, and a discharging portion for stacking bundles of the bound sheets.

Therefore, a large space was required for installation of this conventional sheet discharging stacker. Moreover, the intervals between times at which receiving sheets are discharged from the printer body should be sufficient to allow for reversal of each of the sheets. Consequently, the ability of the printer to process sheets is reduced. Furthermore, the ability of the raw sheet discharging stacker to discharge and process sheets is reduced.

As a sheet discharging stacker for enhancing the ability of the printer to process sheets, there is known a "floor-standing type sheet discharging stacker", which has a sheet stacking device provided under the printer body and a conveying portion, provided outside the printer body, for causing sheets to go around and under the printer body.

This sheet discharging stacker conveys the sheets each having the printed face up along a longitudinal conveying path provided on the rear surface of the printer body. Then, the longitudinal conveying path reverses each of the sheets. Thus, the reversing mechanism becomes unnecessary. This eliminates the reduction in the ability to process sheets, which is caused by the reversing mechanism. Consequently, this sheet discharging stacker efficiently discharges sheets.

Furthermore, a conventional ordinary sheet discharging stacker has an aligning device for aligning printed sheets. This aligning device has an aligning portion that is inclined at about 10 to 30 degrees to the horizontal. The sheets are aligned by being made to abut against a longitudinal wall portion provided at an inclined end portion of the aligning device by utilization of the inclination of this sheet aligning portion and the weight of the sheets themselves. However, the provision of the aforementioned aligning device results in an increase in the height of the sheet discharging stacker.

Moreover, when the sheet discharging stacker is provided under the printer body, the height of the entire printer is increased. This sometimes degrades the operability of the printer to users.

As a countermeasure against this, applicants of the instant application have devised a low profile technical feature that comprises a stacking tray serving as a sheet stacking device for stacking printed sheets, which is nearly horizontal by being inclined less than 10 degrees to the horizontal so as not to depend on alignment of sheets by their own weight. This technical feature further comprises a shutter serving as a sheet abutment device, which is provided in the stacking tray on a downstream side of a sheet conveying direction, a conveying belt serving as a conveying direction alignment device for pressing a sheet against the shutter, and alignment device, provided in a width direction thereof, for aligning the sheets. Thus, the size of the sheet discharging stacker is reduced by decreasing the height of the stacking tray as much as possible. Moreover, the height of the entire printer is reduced. Consequently, users can easily operate the printer.

The aforementioned sheet discharging stacker, however, has a drawback in that jamming occurs due to the fact that a face of a sheet previously brought into and stacked in the sheet stacking device catches a leading edge portion of a sheet later brought thereinto when sheets printed in the printer body are made to go around and are brought into the sheet stacking device nearly horizontally from the sheet conveying portion provided on the rear surface of the printer body.

As a countermeasure, there is proposed a sheet carrying guide disposed at a downstream end of a longitudinal conveying path provided in the vicinity of the sheet stacking device. However, when this countermeasure is taken, the sheet carrying guide is a hindrance to the alignment of sheets stacked in the sheet stacking device. Thus, sheets are sometimes not smoothly brought into the sheet stacking device.

Additionally, sheet jams occur in the image forming apparatus having the aforementioned sheet discharging stacker and hinders the smooth discharging of sheets.

SUMMARY OF THE INVENTION

Accordingly, it is an object of the present invention to provide a sheet receiving/stacking device able to stack sheets by receiving and smoothly carrying sheets into a sheet stacking device.

Another object of the present invention is to provide an image forming apparatus having such a sheet receiving/stacking device, to thereby smoothly discharge sheets, on each of which an image is formed.

To achieve the foregoing objects, according to an aspect of the present invention, there is provided a sheet receiving/stacking device having a sheet stacking device for stacking sheets, a sheet conveying device for conveying sheets to the sheet stacking device, and a sheet guiding device for leading sheets conveyed by the sheet conveying device to the sheet stacking device by guiding a part of the bottom surface of each of the sheets. In this sheet receiving/stacking device, the sheet guiding device is able to move to a guide position, at which the sheet guiding device guides the sheet, and a retracted position at which the sheet guiding device does not guide the sheet.

The device of this configuration has a movable sheet guiding device adapted to guide sheets to the sheet stacking device from thereabove. Thus, a sheet is prevented from being caught in the sheet stacking device. Moreover, occurrence of sheet jamming is prevented. Consequently, sheets are smoothly stacked in the sheet stacking device.

Further, the sheet guiding device is retractable. Thus, when the stacked sheets are aligned, the sheet guiding device is retracted so as not to hinder the alignment of the sheets. Consequently, the alignment thereof is smoothly achieved.

Furthermore, preferably, this device has the following features in addition to the aforementioned features. That is, this device further comprises a pair of aligning devices, provided on the sheet stacking device, for aligning the sheets in the direction of width of the sheet by movement in the direction of width of the sheet of at least one of the pair of aligning devices, and drive device for moving the aligning devices. The sheet guiding device is provided on the moving aligning devices.

The device of this configuration has the sheet guiding device provided in the aligning devices for aligning sheets in the direction of the width of the sheet. Thus, the number of components in the device is decreased. This results in reduction in size and cost of the device. Further, the guiding device is connected with an aligning operation. Thus, the device is easily controlled. Consequently, the reliability of the device is enhanced.

Moreover, even during the operation of aligning the sheets, the next sheet can be carried into the stacking device. Thus, the intervals between times at which sheets are brought into the stacking device are shortened. Consequently, the ability to process sheets is considerably enhanced and productivity is increased.

Furthermore, preferably, there is provided a sheet receiving/stacking device having sheet stacking device for stacking sheets, sheet conveying device for conveying sheets to the sheet stacking device, and sheet guiding device for leading sheets conveyed by the sheet conveying device to the sheet stacking device by guiding a part of the bottom surface of each of the sheets. In this sheet receiving/stacking device, the sheet guiding device is able to move to a guide position at which the sheet guiding device guides the sheet, and a retracted position at which the sheet guiding device does not guide the sheet. The sheet guiding device is adapted to retract by rotating to a sheet stacking surface in the sheet stacking device.

Thus, in the device of this configuration, the sheet guiding device is adapted to retract by rotating to the sheet stacking surface in the sheet stacking device. Consequently, the sheet guiding device catches the sheet and is rotated by its own weight to the retracted position. Hence, the sheet guiding device retracts, so that the sheet guiding device smoothly guides the sheet into the sheet stacking device.

According to yet another aspect of the present invention, there is provided an image forming apparatus having an image forming device for forming an image on a sheet, a sheet conveying portion for conveying the sheet on which an image was formed by the image forming device, and the aforementioned sheet receiving/stacking device for receiving and stacking the sheet conveyed by the sheet conveying portion.

Thus, the image forming apparatus of the present invention has a sheet receiving/stacking device that reliably and smoothly guides sheets into sheet stacking device. Consequently, this image forming apparatus reliably discharges the sheets to the outside of the device.

DESCRIPTION OF THE PREFERRED EMBODIMENTS

Figure 1:
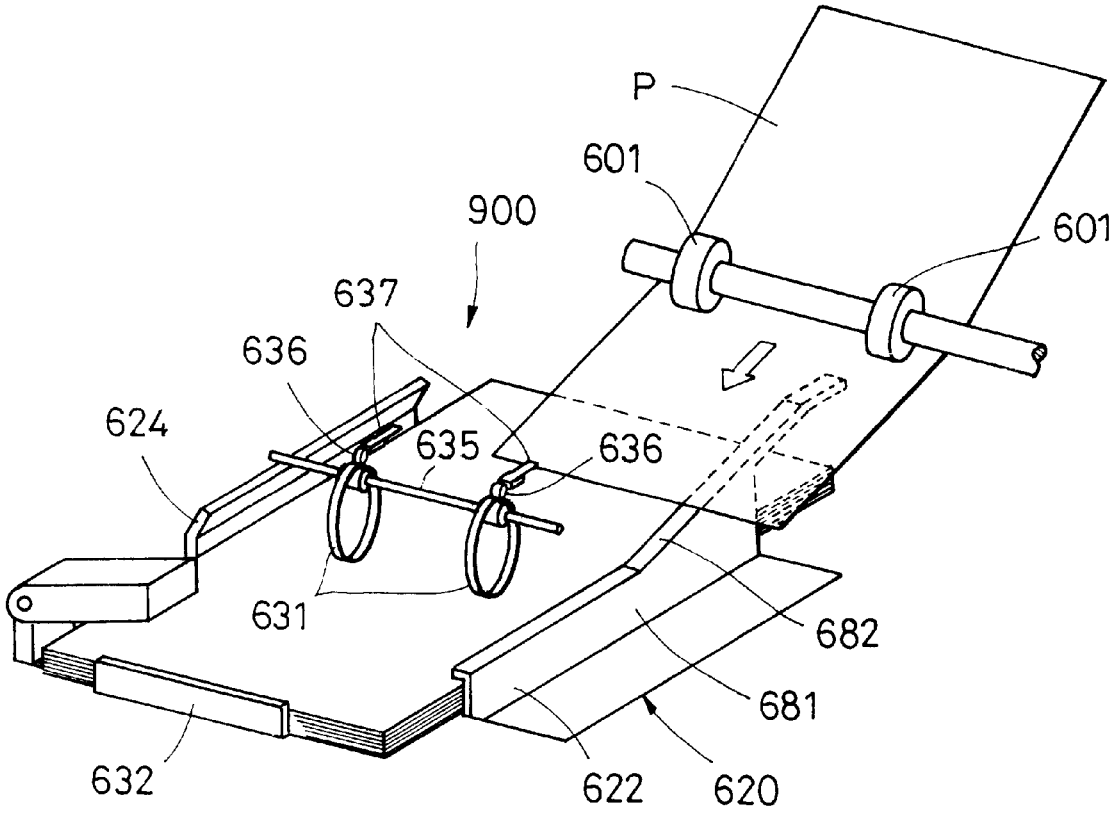
FIG. 1 is a perspective view of a primary part of a sheet receiving/stacking device in a first embodiment of the present invention.

Other features, objects and advantages of the present invention will become apparent from the following description of preferred embodiments with reference to the drawings in which like reference characters designate like or corresponding parts throughout several views.

Hereinafter, preferred embodiments of the present invention will be described in detail by referring to FIGS. 1 to 11.

A sheet receiving/stacking device, which is a first embodiment of the present invention, will be described hereinbelow with reference to FIGS. 1 to 3.

Figure 4:
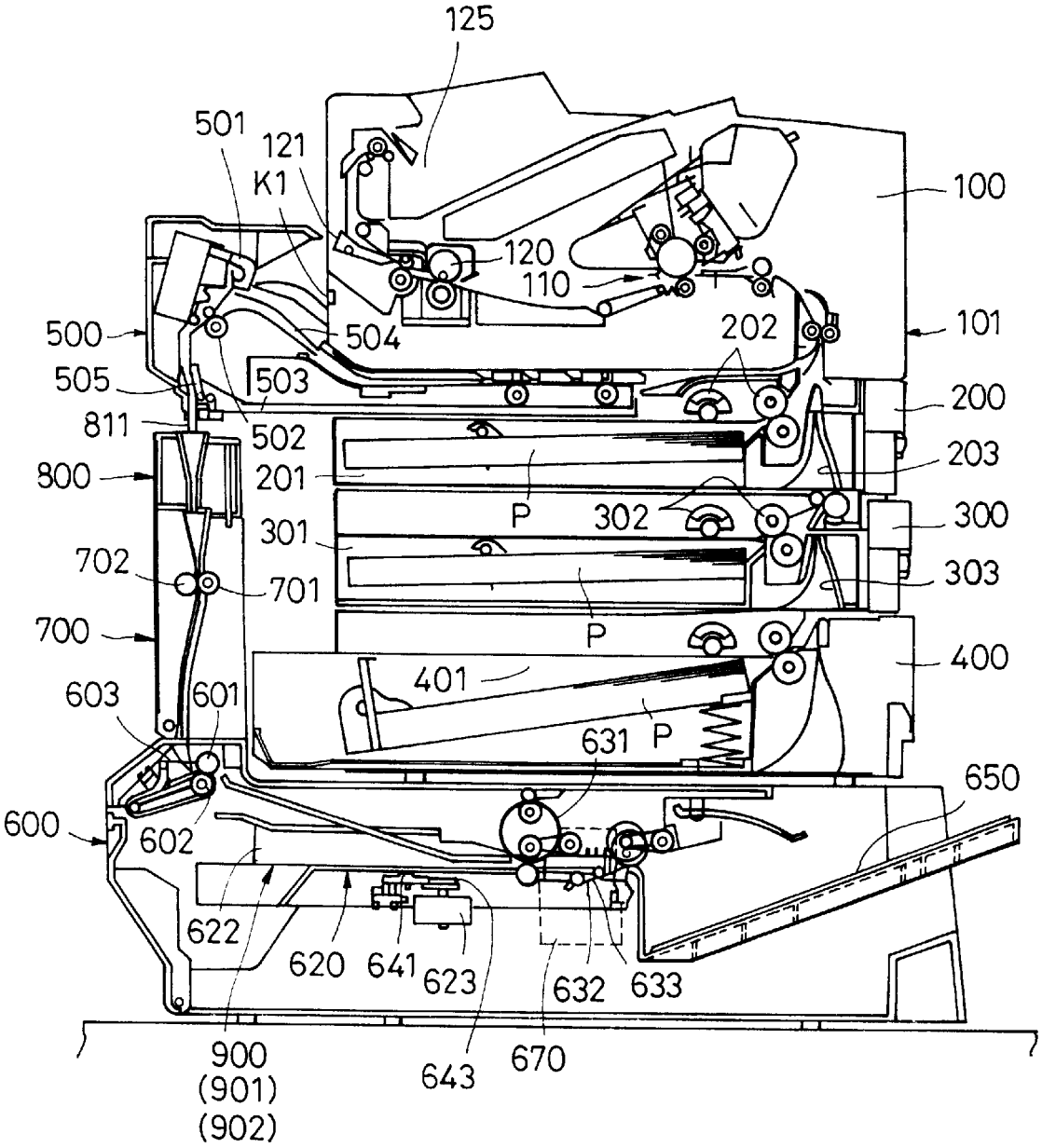
FIG. 4 is a front sectional view of a printer which is an image forming apparatus having the sheet receiving/stacking device of FIG. 1.
Figure 5:
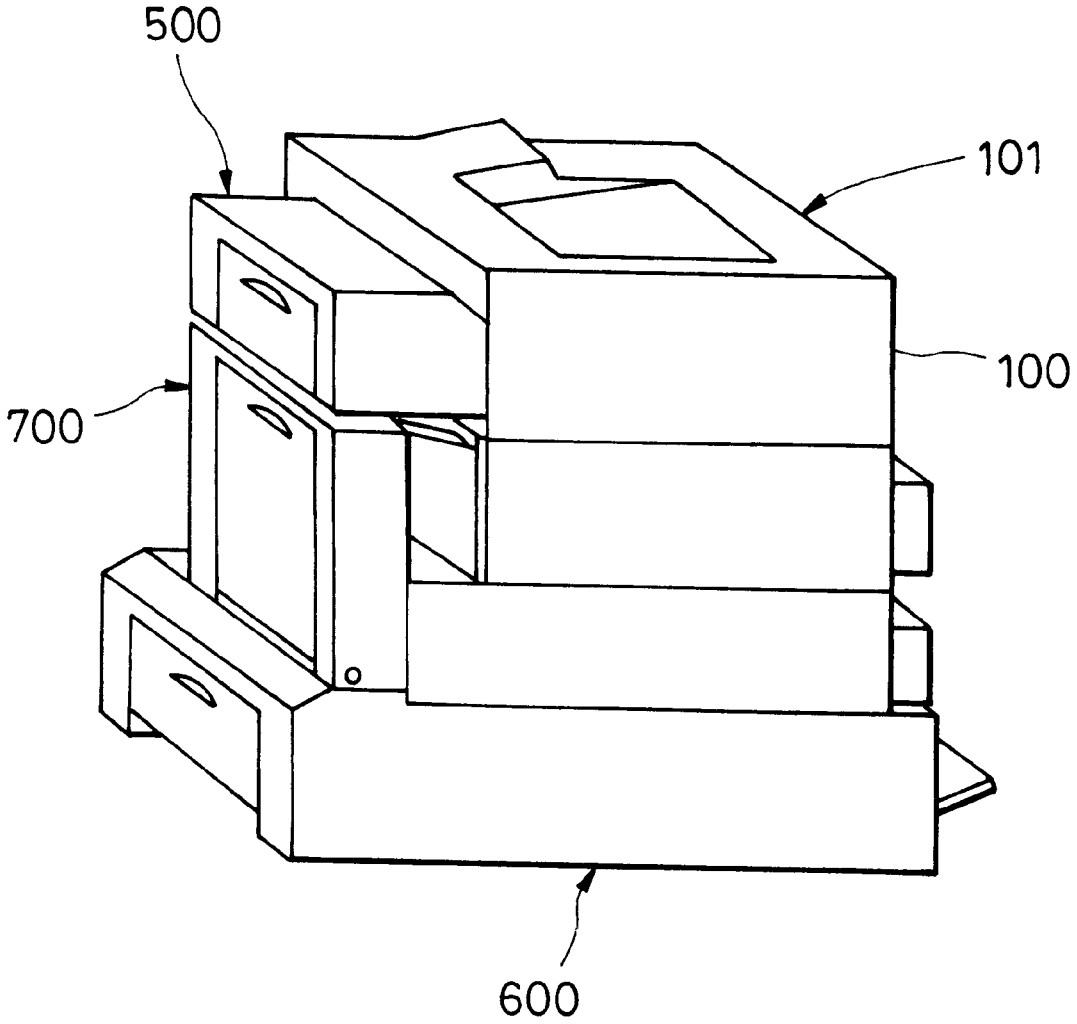
FIG. 5 is a perspective view of the entire printer.
Figure 6:
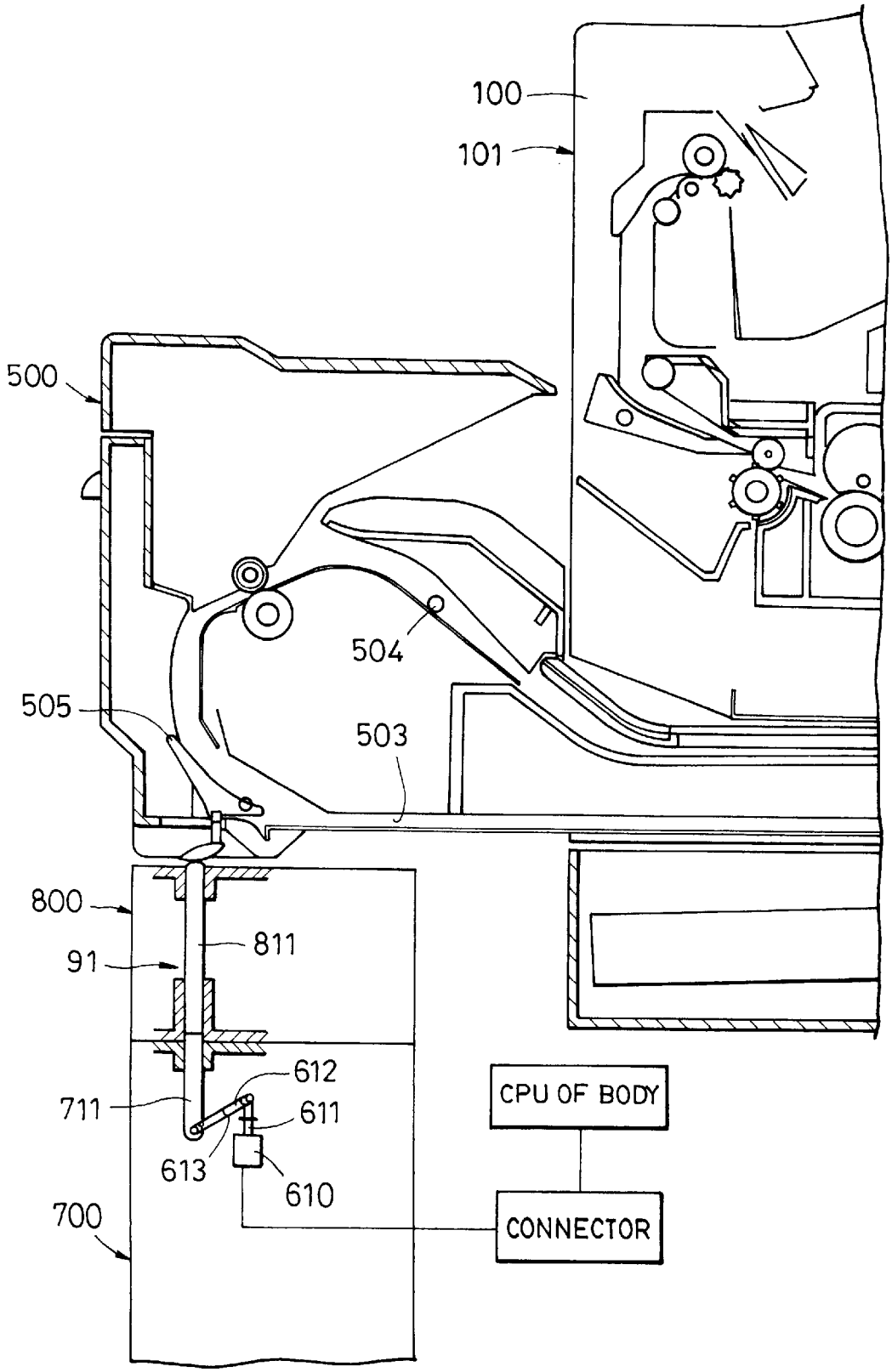
FIG. 6 is a sectional detail view of a longitudinal conveying portion and an extension guide portion of FIG. 4.

First, a laser beam printer (hereinbelow referred to simply as a "printer"), which is an image forming apparatus having the sheet receiving/stacking device that is the first embodiment of the present invention, is described hereinbelow with reference to FIGS. 4 to 6. FIG. 4 is a sectional view showing the configuration of the entire printer 101.

The printer 101 is connected to one computer, or to a network, such as a LAN. The printer 101 prints an image on a sheet by performing a predetermined image forming process according to information sent therefrom, and then discharges the printed sheet.

A first sheet supply device 200 has a detachable sheet cassette 201 adapted to accommodate a plurality of sheets P, and a sheet separating/supplying portion 202 for separating one of the sheets P accommodated in the sheet cassette 201 therefrom and for conveying the separated sheet to the printer body 100. This sheet supply device 200 further has a sheet guiding portion 203 for conveying sheets P supplied from sheet supply devices 300 and 400, which are placed as lower layers, in such a manner as to be able to stack and use the sheets.

The second sheet supply device 300 has a sheet cassette 301, a sheet separating/supplying portion 302, and a sheet guiding portion 303 for conveying sheets P sent from the lower layer, in a manner similar to that of the first sheet supply device 200.

The third sheet supply device 400 has a sheet cassette 401 for accommodating sheets P, in a manner similar to that of the first sheet supply device 200. This sheet cassette 401 is adapted to accommodate a larger number of sheets P, as compared with the aforementioned cassettes 201 and 203. Moreover, this sheet cassette 401 is of sufficient length so as to be able to use long continuous sheets. The rear end of the sheet cassette 401 protrudes from the back face of the printer body 100.

These sheet supply devices 200, 300, and 400 are stacked and positioned by the engagement between positioning pins of the same shape and fitting holes. Furthermore, each of these sheet supply devices is automatically electrically connected to the printer body 100 and to the sheet cassettes through connectors respectively provided at upper and lower portions thereof. Thus, the printer body 100 is adapted to detect the connection state therebetween.

Therefore, users are permitted to select the number of stages or layers of sheet cassettes and the capacity of each of the sheet cassettes, which is adapted to the work environment thereof, with a wide variety of options.

A double-side printing unit 500 is unified and attached to the printer body 100 along the guide formed therein from the left, as viewed in the figure.

The printer body 100 and a double-side printing unit 500 are electrically connected to each other through connectors respectively provided therein. The printer body 100 can supply power to and communicate with the double-side printing unit 500. Moreover, the printer body 100 is adapted to be able to check the connection state therebetween.

A sheet discharging/stacking device 600 having a printer discharging stacker 900 is unified and receives sheets, which are discharged from the printer body 100, on a stacking tray (corresponding to the sheet stacking device) 62, printed side down (that is, with the printed side facing downward), through an extension guide portion 800 and a longitudinal conveying portion 700 that serve as a sheet conveying portion. Then, the sheet discharging/stacking device 600 bundles sheets corresponding to each job and staples the sheets at one or more positions. Subsequently, the device 600 discharges and stacks the stapled sheets. Alternatively, the device 600 discharges and stacks the sheets one by one, printed face down.

In the printer body 100, images are transferred by an image forming device 110 onto sheets P, printed face up, which are selectively supplied from the desired sheet cassette 201, 301, or 401 in response to a predetermined print signal. Subsequently, the images are fixed thereto by a fixing device 120. Then, the sheets, to which the images are fixed, are selectively separated and conveyed to a FD sheet discharging portion 125 or a double-side printing unit 500, which is prepared at an upper portion of the body 100, by a FD flapper 121 in response to a predetermined signal.

The sheets P conveyed to the double-side printing unit 500 actuates a double-side printing sheet conveyance sensor lever 501.

In the case of issuing an instruction to perform a double-side printing operation on the sheets conveyed thereto, the sensor lever 501 actuated by the conveyed sheet P drives a downstream double-side printing sheet conveying roller 502 with predetermined timing to thereby lead the sheet P to a reverse conveying path 503. Subsequently, when the rear edge of the sheet P passes through the sensor lever 501, this sensor lever 501 drives the roller 502 in reverse. Consequently, the sheet P is conveyed to a double-side printing sheet carrying path 504, and is then conveyed again to the printer body 100, in which an image is printed on the unprinted side of the sheet P. Thus, images are printed on both sides of the sheet P.

Next, an operation of each of components of the device in the case, in which the conveyed sheet P goes to the unitized sheet discharging/stacking device 600, is described hereinbelow.

When the sheet P is brought into the double-side printing unit 500 and activates the sensor lever 501, this sensor lever 501 drives the downstream conveying roller 502 with predetermined timing. Then, the sensor lever 501 issues a signal to the sheet discharging/stacking device 600 and pulls a plunger 611 of a flapper solenoid 610, so that a lever 612 rotatably attached to the plunger 611 is downwardly retracted or rotated around the center of rotation 613.

This lever 612 is supported on the rotating shaft 613, and thus rotates around this rotating shaft 613 serving as the center of rotation. This causes the support side of a link lever 711 to rotate upward, so that the link levers 711 and 811 are pushed upward. Thus, a flapper 505 provided in the double-side printing unit is rotated. The conveying path is opened to the sheet discharging/stacking device 600. Hence, the sheet P is guided and carried into the sheet discharging/stacking device 600 through the extension guide 800 and the longitudinal conveying portion 700.

As shown in FIG. 4, the longitudinal conveying portion 700 is disposed at a location off a sheet cassette 401 projecting from the printer body 100. Thus, the longitudinal conveying portion 700 is slightly displaced from the exterior of the printer body 100.

The sheet having passed through the extension guide 800 and being conveyed to the longitudinal conveying portion 700 is discharged to the sheet receiving stacker 900 by the longitudinal conveying roller 701, a conveying roller 702 rotatably pressed by the longitudinal conveying roller 701, an aligning discharge roller (corresponding to the sheet conveying device) 601 provided in the sheet discharging/stacking device 600, and an aligning discharge roller (corresponding to the sheet conveying device) 602 rotatably pressed against the aligning discharge roller 601.

At that time, the sheet printed in the printer body 100, printed side up, goes around and under the printer body 100 and is then discharged therefrom. Thus, the printed sheet is discharged therefrom, printed side down, and is then stacked in page order and is aligned.

An aligning discharge sensor 603 acting as a sheet detecting device is provided upstream from the nip between the aligning discharge rollers 601 and 602. This aligning discharge sensor 603 is operative to detect the timing at which the sheet is carried into the stacker, and the timing at which the rear end of the sheet passes through the nip portion.

After elapse of a predetermined time since the timing at which the sheet was carried into the stacker is detected, this aligning discharge sensor 603 actuates a lateral registration aligning plate ((corresponding to the aligning device) to be described later) 622 and detects a sheet jam.

Furthermore, as illustrated in FIG. 1, each of longitudinal aligning belts 631 acting as conveying direction aligning device is driven and rotated in a region between the corresponding aligning discharge roller 601 serving as the sheet conveying device and the corresponding shutter 632 serving as the sheet abutment device by a corresponding aligning belt drive roller 635 and a roller spring 637 opposed to the corresponding roller 635. Thus, the belts 631 apply a weak conveying force in a sheet conveying direction to the sheet conveyed by the sheet conveying device.

Even after the leading edge of the sheet abuts against a stopper 633, the longitudinal aligning belts 631 continue to rotate in a direction in which the leading edge of the sheet abuts against the stopper 633. However, the conveying force is set to be weak. Thus, the belts 635 neither bend the sheet nor force the shutter 633 to open.

Actually, the longitudinal aligning belts 631 are set so that a conveying force of about 0.049 N (that is, about 5 gf) to about 0.098 N (that is, about 10 gf) is applied to the sheet.

First Embodiment

Hereinafter, the sheet receiving stacker 900, which is the first embodiment of the present invention, will be described in detail with reference to FIGS. 1 to 4, 10, and 11.

Figure 10:
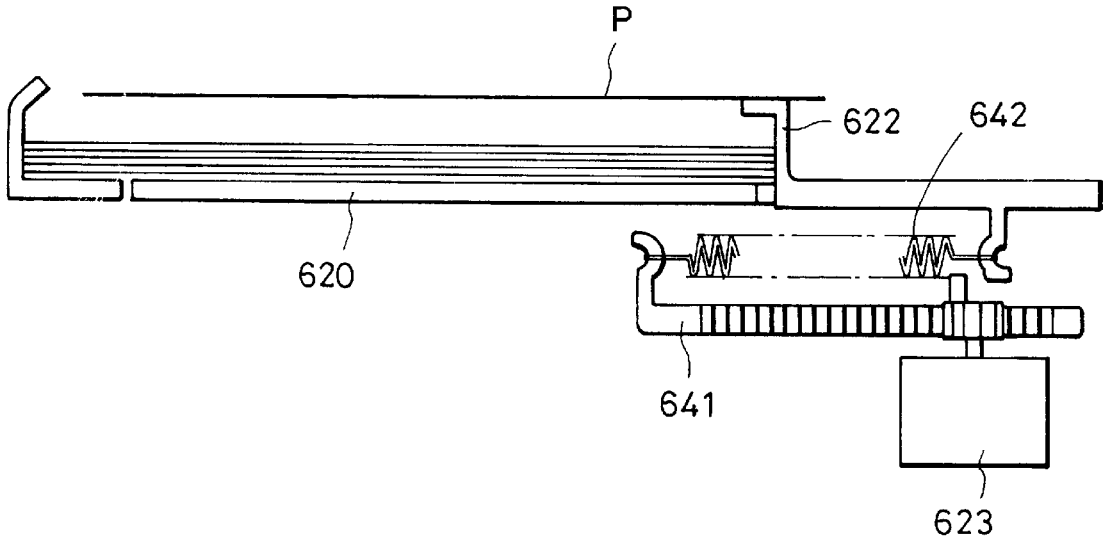
FIG. 10 is a diagram illustrating a drive mechanism for an aligning device, which is in a sheet aligning position.
Figure 11:
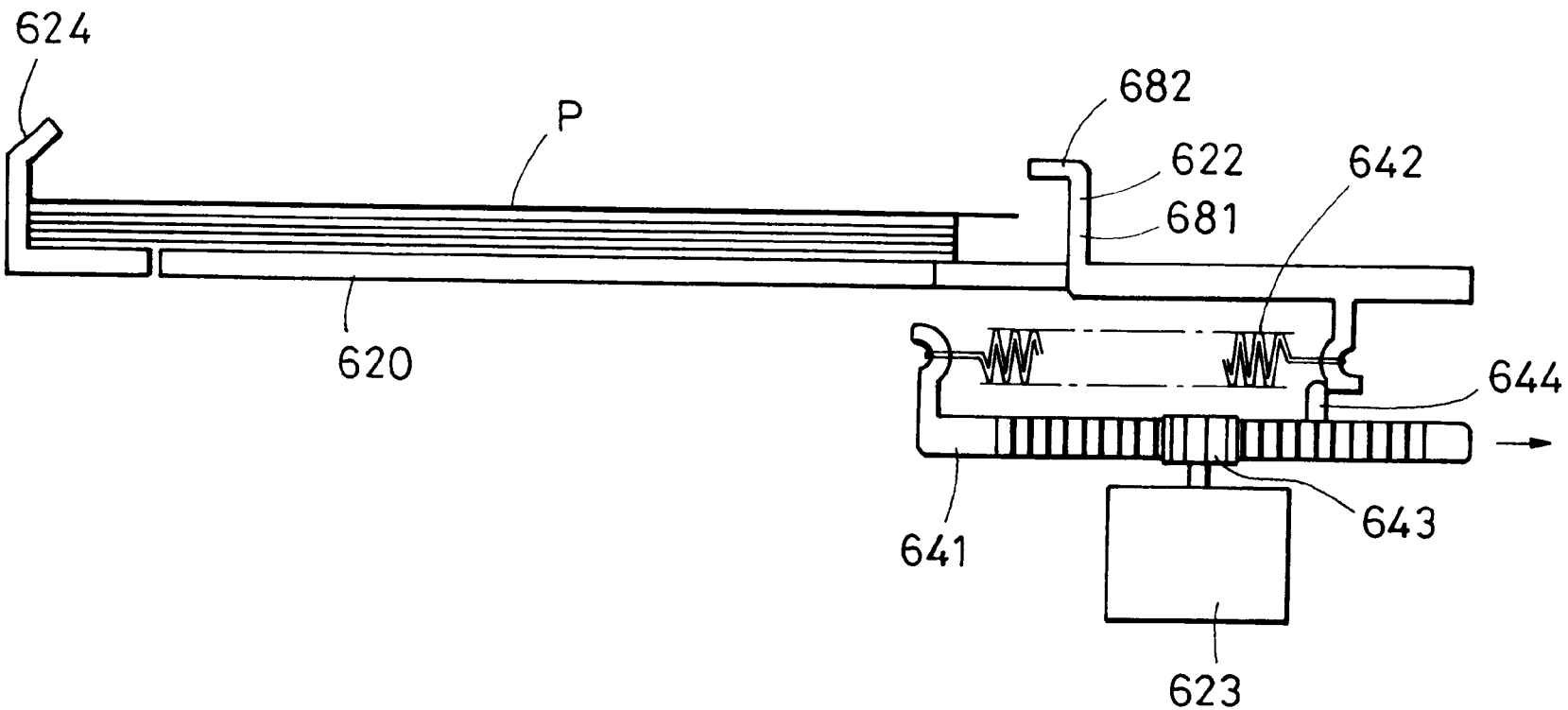
FIG. 11 is a diagram illustrating a drive mechanism for an aligning device, which is in an aligning device retracted.

As shown in FIGS. 10 and 11, a lateral registration aligning plate serving as the aligning device is moved by a lateral registration motor 623 serving as the drive device to the sheet aligning position illustrated in FIGS. 10 and to the aligning device retraction position, in which the aligning device does not align, as illustrated in FIG. 11. Further, this lateral registration aligning plate 622 is constituted by an aligning wall 681, which operates to push an end surface portion of the sheet when the sheet is moved in the direction of width thereof, and a sheet guiding member (that is, the sheet guiding device) 682, provided on the top face of this aligning wall 681 at an upstream side of the direction, in which the sheet is conveyed, for aiding in carrying the sheet into the stacker. This sheet guiding member (corresponding to the sheet guiding device) 682 is placed above the stacking face of a sheet bundle stacked on the sheet stacking tray 620 serving as the sheet stacking device, which is nearly horizontal, and under the sheet conveying device 601. Further, a guiding face constituted by a slope inclined to the height thereof for smoothly guiding the sheet, which is conveyed from the sheet conveying device, into the sheet stacking device is formed in the sheet guiding member 682. Furthermore, the guiding of the sheet is stably performed by extending the sheet guiding member 682 to the upstream side of the sheet conveying direction. According to this embodiment, the aligning device and the sheet guiding member are formed integrally. Thus, the configuration of the stacker is simplified. Moreover, the size and cost of the stacker are reduced. Furthermore, the guiding device is connected with an aligning operation. Thus, the device is easily controlled. Consequently, the reliability of the device is enhanced.

A reference plate (corresponding to the aligning device) 624 serving as a reference in the direction of width of the sheet is provided at a place, which is at a predetermined distance in the direction of width of the sheet away from a sheet discharging place, on the stacking tray 620. The alignment in the direction of width of the sheet is performed by pushing the sheet P to the reference plate 624 by using the lateral registration aligning plate 622 by a predetermined distance time the sheet P is stacked.

Therefore, when the lateral registration aligning plate 622 is in the aligning position shown in FIG. 10, the lateral registration aligning plate 622 is placed within the sheet conveying region in the direction of the width of the sheet, while the sheet guiding member 682 is placed in the guiding position. An example of an operation of the lateral registration aligning plate 622 is described in detail hereinbelow. Operations, such as an aligning operation, of the lateral registration aligning plate 622 is controlled through a pinion gear 643 and a lateral registration rack 641, which are driving-force transmitting device, by controlling the normal or reverse rotation of a lateral registration aligning motor 623. An aligning spring 642 is used to eliminate the influence of variation in sheet size (in the direction of the width of the sheet) and the over-stroke of the lateral registration aligning plate 622 during the alignment of a sheet bundle is performed. As illustrated in FIG. 11, when the aligning device retracts, the lateral registration plate 622 pressed by an aligning spring 642 is fixed by a stopper portion 644 of the lateral registration rack 641. During an aligning operation, even when the lateral registration rack 641 is moved by a distance larger than the sheet size (in the direction of the width of the sheet), the lateral registration aligning plate 622 stops at a place in which the plate 622 abuts against the sheet bundle, as illustrated in FIG. 10. Thus, excessive pressure is prevented from being exerted on the sheet bundle.

When the sheet P is carried into the stacking tray 620, the lateral registration aligning plate 622 is moved to the aligning position illustrated in FIGS. 1 and 10. Thus, the sheet P is carried thereinto by guiding a part thereof by a guiding portion 682 provided in the lateral registration plate 622 as illustrated in FIG. 1.

Thus, as a result of the fact that the sheet P is partly guided by the guiding portion 682 of the lateral registration plate 622, even when a sheet-entry angle formed between the longitudinal conveying portion 700 and the sheet P brought therefrom into the near horizontal stacking tray 620 is large, the stacking tray 620 does not catch the edge portion of the sheet. Thus, occurrence of sheet jamming is prevented.

Figure 2:
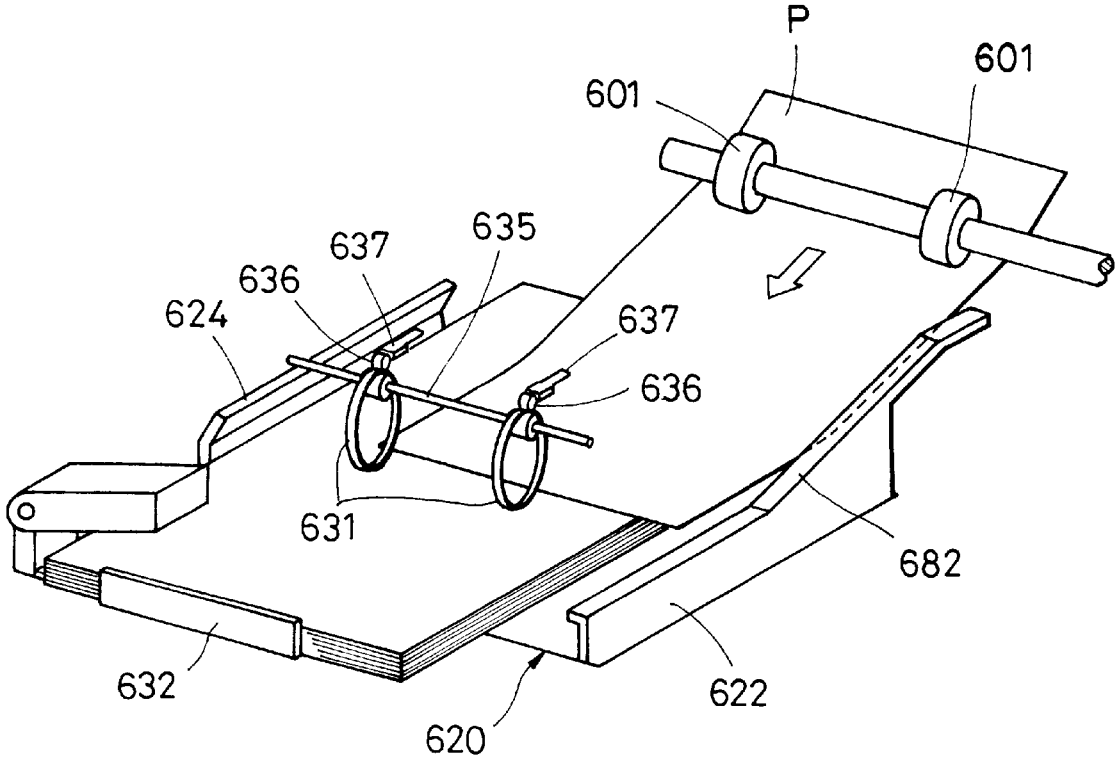
FIG. 2 is a diagram illustrating an operation of the sheet receiving/stacking device of FIG. 1.
Figure 3:
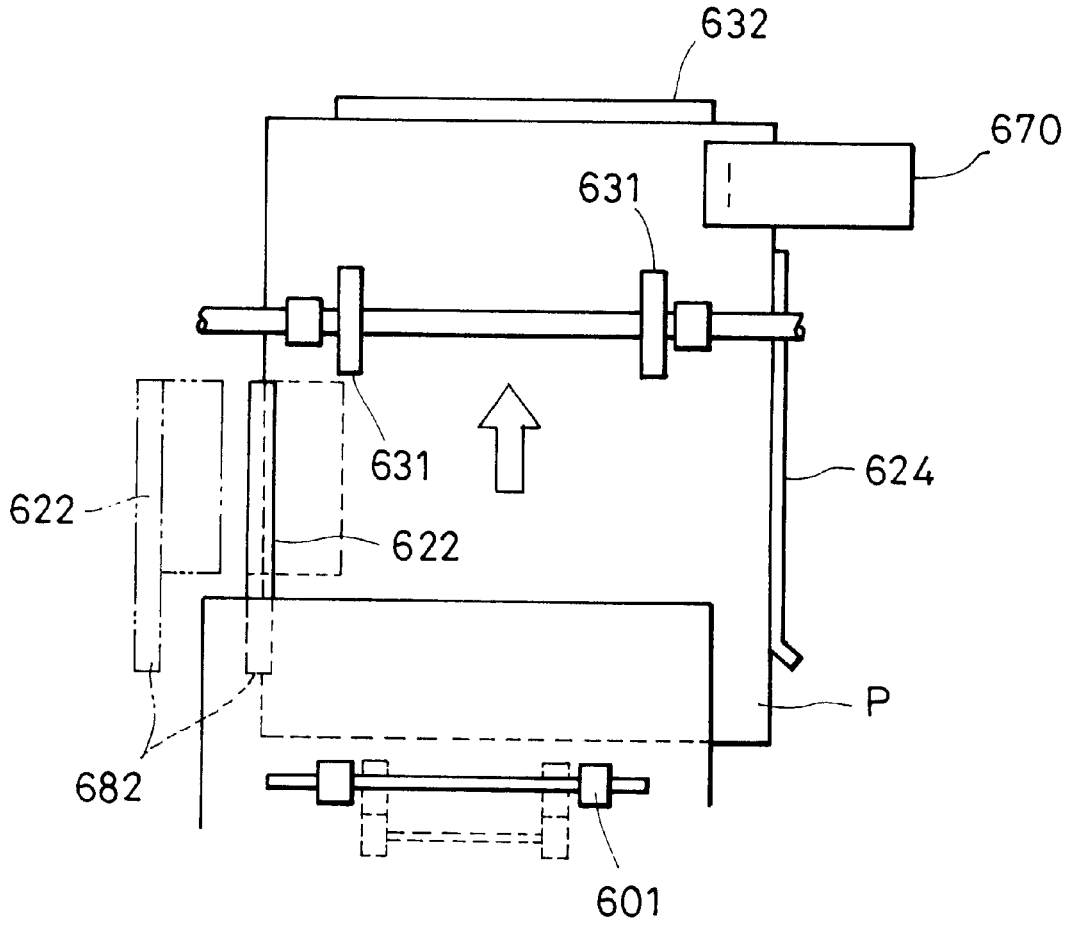
FIG. 3 is a plan view of the sheet receiving/stacking device of FIG. 1.

When the leading edge portion of the sheet P carried thereinto is nipped by a longitudinal aligning belt 631 provided on the stacking tray 620, the lateral registration aligning plate 622 and the sheet guiding member 682 retract once to the retracted position provided outside a region, in which the sheet is conveyed in the direction of width thereof,as illustrated in FIG. 2. Thus, the reliability of delivery of the sheet is enhanced by guiding the sheet by means of the guiding member until the sheet is nipped by the longitudinal aligning belt. Moreover, a failure in conveyance of sheets, for example, oblique movement of the sheets, is prevented.

Consequently, when the sheet is carried thereinto, the sheet drops from the guiding portion 682 of the lateral registration aligning plate 622 onto the stacking tray 620. Then, the sheet is carried until the leading edge thereof abuts against the shutter 632.

The lateral registration aligning plate 622 moves again to the aligning position after the leading edge of the sheet abuts against the shutter 632. Then, the alignment of the sheet in the direction of its width is performed by causing the conveyed sheet to abut against the reference plate 624.

During this time, the longitudinal aligning belt 631 keeps pressing the sheet in a direction in which the sheet abuts against the shutter 632. However, the longitudinal aligning belt has a flexible structure and thus does not hinder the alignment in the direction of the width of the sheet. Consequently, the alignment of the sheet, in each of the direction in which the sheet is brought into the stacking tray 20, and the direction of the width of the sheet, is neatly achieved.

The lateral registration aligning plate 622 repeats the movement between the aligning position and the retracted position or an aligning standby position, which is slightly displaced from the aligning position, and the aligning operation of pressing the side face of the sheet P a plurality of times until the next sheet is brought thereinto. Consequently, the alignment of the sheet is more neatly achieved.

Subsequently, the second sheet P or later is similarly brought into the stacking tray 620 while the lateral registration aligning plate 622 is held in the aligning position. The sheet P is guided by the guiding portion 682 provided on the lateral registration aligning plate 622. Upon carrying a predetermined length of sheet into the stacking tray 620, the aligning plate 622 retracts to the retracted position. Then, the sheet P brought thereinto is stacked onto the sheets previously stacked and aligned. Subsequently, the aligning plate 622 is moved again to the aligning position so as to perform the alignment of the sheets.

Even in the case in which the interval between times at which the sheets are brought into the stacking tray are short and the next sheet is carried onto the guiding portion 682 of the lateral registration plate 622 during this aligning operation, the lateral registration aligning plate 622 is present within the sheet conveying place or region. Thus, the guiding portion 682 guides the next sheet without problem. Consequently, the ability to process the sheets is enhanced.

Thus, bundles of sheets of a predetermined number stacked on the stacking tray 620 are bound by performing post-processing measures, such as a stapling processing. Then, the bound sheets are discharged to a discharging tray 650 and are stacked therein.

Second Embodiment

Hereinafter, a sheet receiving stacker 901, which is the second embodiment of the present invention, will be described with reference to FIGS. 7 and 8. In these figures, like reference characters designate like or corresponding components of the aforementioned sheet receiving stacker 900.

In the case of the sheet receiving stacker 900 of the first embodiment, the lateral registration aligning plate 622 is provided only on one side of the tray. Furthermore, the alignment of sheets is performed by pressing sheets against the reference plate 624 provided on the other side thereof. That is, what is called the "one-side reference method", is employed.

Figure 7:
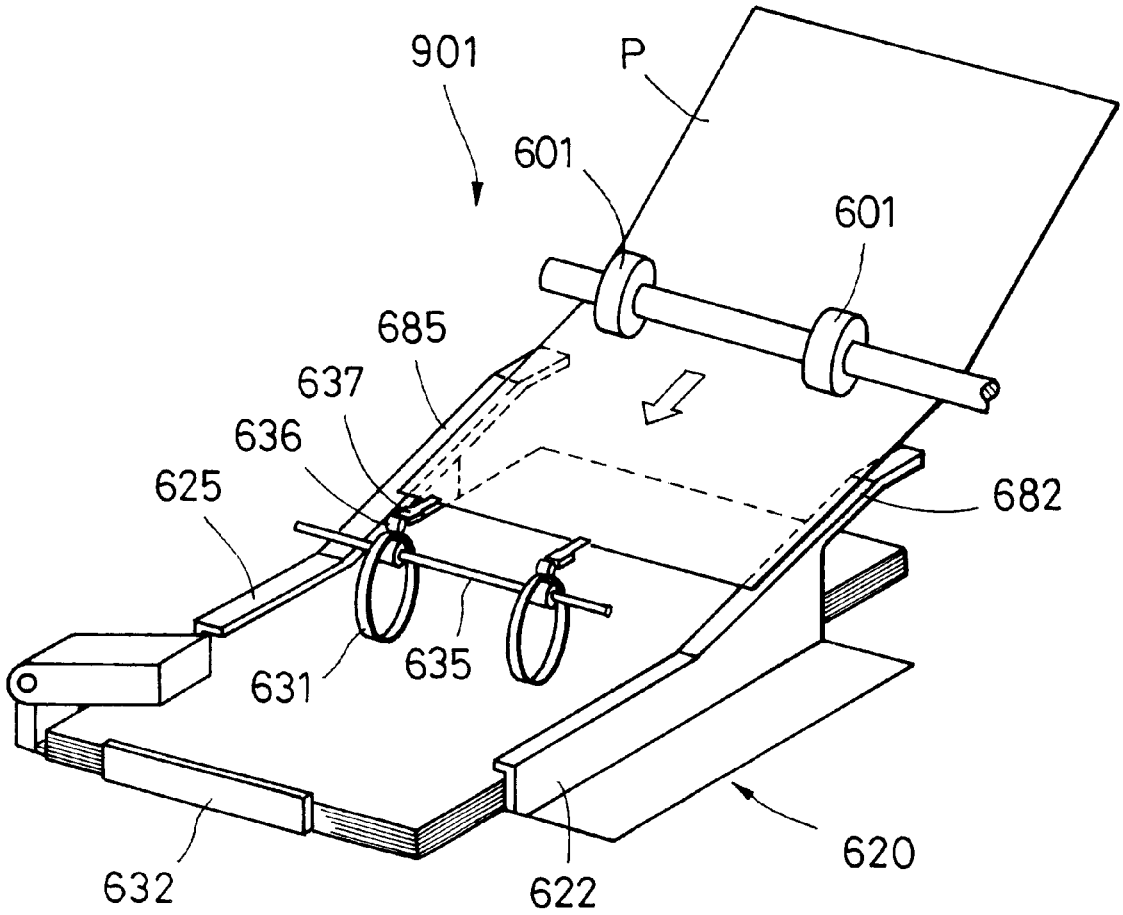
FIG. 7 is a perspective view of a primary part of a sheet receiving/stacking device in a second embodiment of the present invention.
Figure 8:
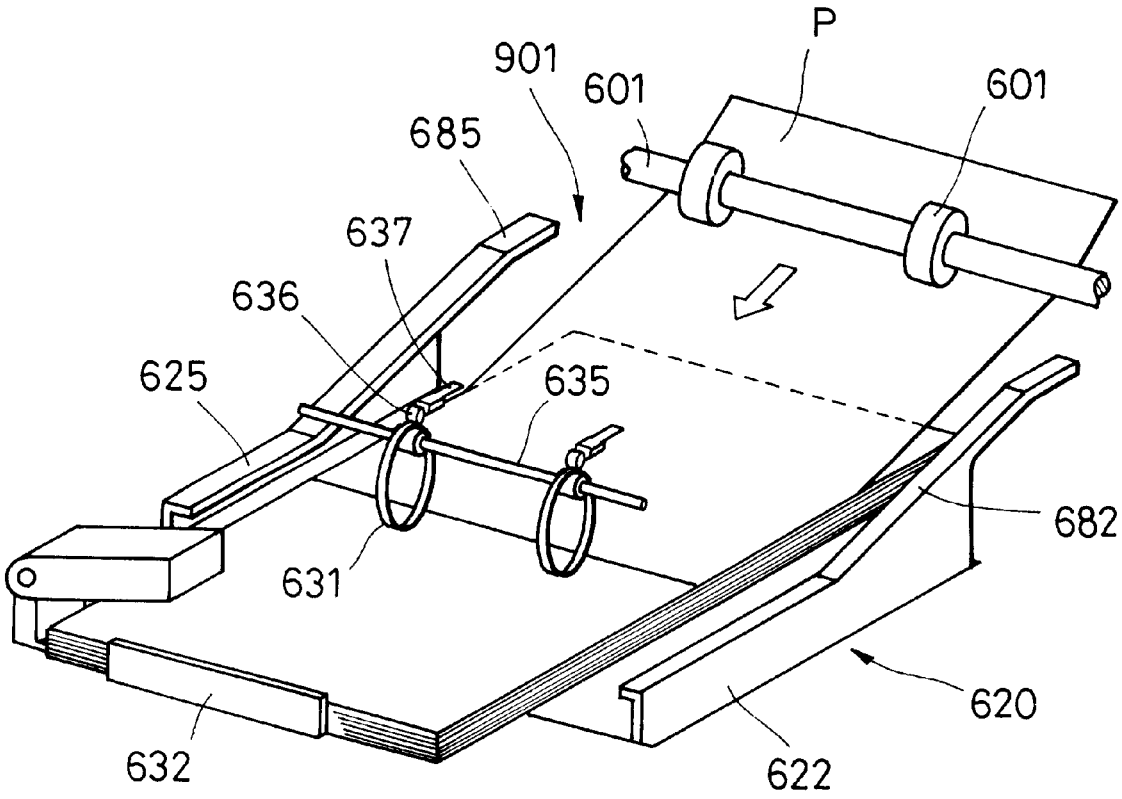
FIG. 8 is a diagram illustrating an operation of the sheet receiving/stacking device of FIG. 7.

In contrast, in the case of the sheet receiving stacker 901 of the second embodiment of the present invention, a movable lateral registration aligning plate (corresponding to the aligning device) 625 opposed to the lateral registration aligning plate 622 is provided, as illustrated in FIG. 7. Moreover, a guiding portion (corresponding to the sheet guiding member) 685, similar to the movable lateral registration aligning plate 622, is provided on the lateral registration aligning plate 625. When a sheet P is carried thereinto, the bottom faces of both end portions of the sheet P are guided.

Thus, this sheet receiving stacker 901 is able to act as a sheet receiving stacker employing what is called a "sheet center reference method".

Furthermore, with such a configuration, the sheet P is carried into the sheet receiving stacker 901 by guiding both end faces of the sheet. Consequently, the sheets are smoothly brought thereinto. Moreover, the alignment of the sheets is smoothly achieved.

Third Embodiment

Figure 9:
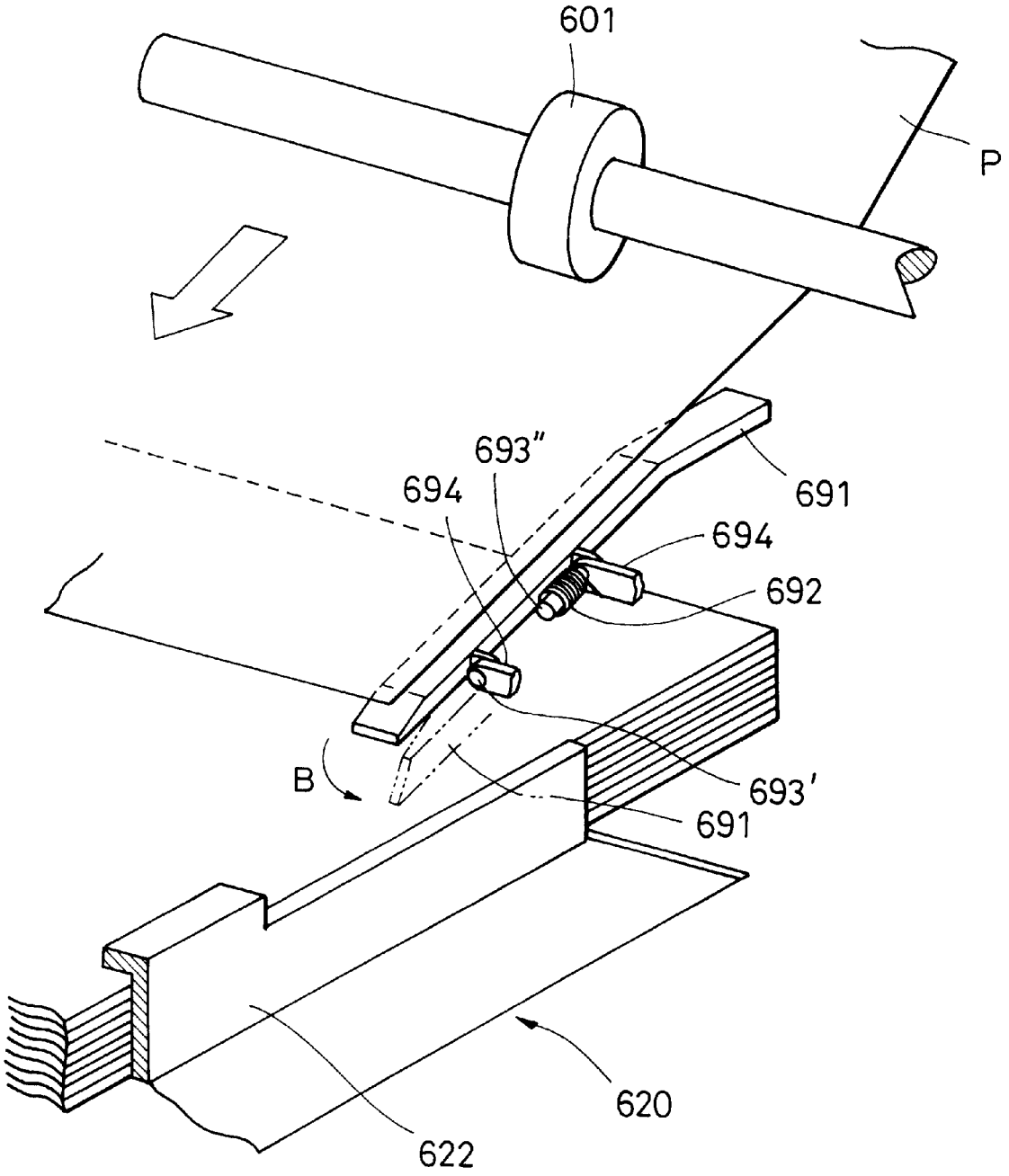
FIG. 9 is a perspective view of a primary part of a sheet receiving/stacking device in a third embodiment of the present invention.

Hereinafter, a sheet receiving stacker 902, which is the third embodiment of the present invention, will be described with reference to FIG. 9. In this figure, like reference characters designate like or corresponding components of the sheet receiving stacker 900 of the first embodiment. Thus, description of such components is omitted.

A sheet guiding portion (corresponding to the sheet guiding member) of the sheet receiving stacker 902 of the third embodiment is separated from the lateral registration aligning plate 622 serving as the aligning device. Furthermore, the sheet guiding portion 691 is adapted to rotate to the stacking tray 620 due to the weight of the sheet, as indicated by phantom lines.

The guiding member 691 is mounted on the stacker in such a manner as to be able to rotate by a predetermined angle around the support shafts 693' and 693' serving as the center of rotation, which are provided on a bracket formed in such a way as to be integral with the stacker, nearly in parallel with respect to a sheet carry-in angle. The support portions are provided outside the region in which the sheet to be conveyed by the sheet conveying device 601 is conveyed. Furthermore, the support portions are adapted in such a manner as not to hinder the carrying of the sheet into the sheet stacking device. A torsion spring 692 is coaxially provided on the support shaft 693' and is set on both the guiding member 691 and the bracket 694. The guiding member 691 is pressed and rotated clockwise by the torsion spring 692, as viewed in this figure.

A stopper (not shown) is provided on the guiding member 691 in such a manner as to prevent this guiding member from moving beyond the guiding position in which the guiding member can guide the sheet P. That is, the guiding member 691 is usually held in such a way as to be parallel with the stacking tray 620. However, the guiding member 69 is not adapted to rotate from such a position in a direction in which the member 69 moves away from the stacking tray 620.

Thus, the guiding member 691 is usually held by the pressing force of the torsion spring 692 in a position in which this member 691 can guide a sheet.

When a sheet P is brought into the sheet receiving stacker 902, the end face portion of the sheet P is guided by the guiding member 691 so that the sheet is smoothly led to the stacking tray 620.

However, when the rear end portion of the sheet P leaves the nip between the aligning discharge rollers 601 and 602 (see FIG. 4), the sheet P rotates the guiding member 691 counterclockwise, as indicated by arrow B, against the pressing force of the torsion spring 692, and then drops onto the stacking tray 620 by the weight of the sheet P.

In the third embodiment, the guiding member 691 is formed in such a way as to be separated from the aligning device 622. However, the guiding member 691 may be provided in such a fashion as to be integral with the aforementioned reference plate 624 and the lateral registration aligning plate 625.

Furthermore, although the sheet guiding member is rotated and retracted in the aforementioned embodiment, the stacker may be adapted by using the drive mechanism of the first embodiment illustrated in FIGS. 10 and 11, or alternatively, by using a known mechanism so that only the sheet guiding device is retracted in a direction parallel to the direction of sheet width. Even in this case, similar effects are obtained.

Incidentally, the sheet receiving stacker of the present invention is provided in the body of the image forming apparatus, and thus may be incorporated into the body of a printer, a copier, a facsimile machine, or a composite apparatus thereof.

As described above, the sheet receiving stacker of the present invention has a retractable sheet guiding member. Thus, sheets are guided from above to the sheet stacking device. Hence, the sheet stacking device does not catch the sheet. Consequently, occurrence of sheet jamming is prevented. Additionally, sheets are smoothly stacked in the sheet stacking device.

Furthermore, the sheet guiding member is retractable. Thus, when stacked sheets are aligned, the sheet guiding member is retracted in such a manner as not to hinder the alignment of the sheets. Consequently, the alignment of the sheets is smoothly attained.

Furthermore, as a result of smoothly performing the alignment of sheets without causing sheet jamming, bundles of sheets are securely stapled by, for example, a stapler.

Moreover, even while the alignment of a sheet is performed, the next sheet may be carried into the stacking device. Thus, the interval between times at each of which a sheet is brought into the stacking device is reduced. Consequently, the ability to process sheets is considerably enhanced and productivity is increased.

The sheet receiving stacker of the present invention has a sheet guiding member provided on the aligning device for aligning sheets in the width direction thereof. Thus, the number of components is decreased. Hence, the size and cost is reduced. Furthermore, the guiding device is connected with an aligning operation. Thus, the device is easily controlled. Consequently, the reliability of the device is enhanced.

Moreover, the sheet guiding member is provided in a pair of the aligning plates. Thus, the sheet receiving stacker of the present invention may be applied to that adapted to convey sheets by employing the center reference method. Consequently, the range of applications of this sheet receiving stacker is broad.

Furthermore, in the case of the sheet receiving stacker of the present invention, the sheet guiding member is retracted by being rotated to the sheet stacking face on the sheet stacking device. Thus, sheets are smoothly guided into the sheet stacking device by stopping sheets and then rotating and retracting the sheet guiding member to the retracted position by the weight of the sheet.

The image forming apparatus of the present invention has a sheet receiving stacker which is able to smoothly and reliably guide sheets into the sheet stacking device. Thus, this image forming apparatus reliably discharges sheets out of the body thereof.

Although preferred embodiments of the present invention have been described above, it should be understood that the present invention is not limited thereto and that other modifications will be apparent to those skilled in the art without departing from the sprint of the invention.

The scope of the present invention, therefore, should be determined solely by the appended claims.

Which is claimed is:

1. A sheet receiving and stacking device comprising:

sheet stacking means for stacking sheets;

sheet conveying means for conveying sheets to said sheet stacking means; and sheet guiding means for leading sheets conveyed by said sheet conveying means to said sheet stacking means by guiding a part of a bottom surface of each sheet, wherein said sheet guiding means is moveable between a guide position at which said sheet guiding means guides the sheet, and a retracted position at which said sheet guiding means does not guide the sheet, and wherein said sheet guiding means aligns in a widthwise direction the sheets stacked on said sheet stacking means while guiding a bottom surface of the guided sheet in the guide position.

2. The sheet receiving and stacking device according to claim 1, wherein said sheet stacking means is approximately horizontally disposed.

3. The sheet receiving and stacking device according to claim 2, further comprising:

sheet abutment means which is placed at a downstream end of said sheet stacking means in a sheet conveying direction; and conveying direction alignment means for aligning the sheets in the sheet conveying direction by pressing the sheets against said sheet abutment means.

4. The sheet receiving and stacking device according to claim 1, wherein said sheet guiding means retracts by moving in a direction of a width of the sheet.

5. The sheet receiving and stacking device according to claim 4, further comprising:

a pair of aligning means for aligning the sheets which are stacked on said sheet stacking means in the direction of the width of the sheet by movement in the direction of the width of the sheet of at least one of said pair of aligning means; and drive means for moving aligning means, wherein said sheet guiding means is provided on said moving aligning means.

6. The sheet receiving and stacking device according to claim 5, wherein said moving aligning means is adapted to move between a sheet aligning position, in which said moving aligning means aligns the sheets, and an aligning means retracted position, in which said moving aligning means does not align the sheets, and wherein the sheet aligning position is provided in a region, in which the sheet conveyed by said sheet conveying means is conveyed in a direction of width of the sheet, and the aligning means retracted position is provided outside the region.

7. The sheet receiving and stacking device according to claim 6, wherein when the sheet is conveyed by said sheet conveying means to said sheet stacking means, said moving aligning means is first moved to said sheet aligning position, so that the sheet is guided by said sheet guiding means, and subsequently, said moving aligning means is moved to the aligning means retracted position.

8. The sheet receiving and stacking device according to claim 1, wherein said sheet guiding means is adapted to retract by rotating to a sheet stacking surface on said sheet stacking means.

9. The sheet receiving and stacking device according to claim 8, wherein said sheet guiding means comprises a support portion serving as a center of rotation, provided outside a region in which the sheet conveyed by said conveying means is conveyed in a direction of a width of the sheet, and pressing means for applying a pressing force onto said guiding means so that said guiding means is held in the guide position.

10. The sheet receiving and stacking device according to claim 9, wherein said sheet guiding means retracts by simultaneously opposing the pressing force of said pressing means by the weight of the sheet.

11. The sheet receiving and stacking device according to claim 10, wherein after the sheet is discharged from said sheet conveying means, said sheet guiding means retracts.

12. A sheet receiving and stacking device having sheet stacking means for stacking sheets, sheet conveying means for conveying sheets to said sheet stacking means, and sheet guiding means for leading sheets conveyed by said sheet conveying means to said sheet stacking means by guiding a part of a bottom surface of each of the sheets, said sheet receiving and stacking device comprising:

a sheet guiding member, disposed above said sheet stacking means and under said sheet conveying means, for guiding a part of a bottom surface of the sheet conveyed by said sheet conveying means and leading the sheet to said sheet stacking means, wherein said sheet guiding member is moveable between a guide position, in which said sheet guiding member guides the sheet, and a retracted position in which said sheet guiding member does not guide the sheet, and wherein said sheet guiding means aligns in a widthwise direction the sheets stacked on said sheet stacking means while guiding a bottom surface of the guided sheet in the guide position.

13. The sheet receiving and stacking device according to claim 12, wherein said sheet guiding member has a guide surface having a face inclined with respect to a vertical direction.

14. The sheet receiving and stacking device according to claim 12, wherein said sheet guiding member retracts by moving in the direction of a width of the sheet.

15. The sheet receiving and stacking device according to claim 12, wherein said sheet stacking means is approximately horizontally disposed.

16. The sheet receiving and stacking device according to claim 15, further comprising:

sheet abutment means which is placed at a downstream end of said sheet stacking means in a sheet conveying direction; and conveying direction alignment means for aligning the sheets in the sheet conveying direction by pressing the sheets against said sheet abutment means.

17. The sheet receiving and stacking device according to claim 14, further comprising:

a pair of aligning means for aligning the sheets which are stacked on said sheet stacking means in the direction of the width of the sheet by movement in the direction of the width of the sheet of at least one of said pair of aligning means; and drive means for moving aligning means, wherein said sheet guiding member is provided on said moving aligning means.

18. The sheet receiving and stacking device according to claim 12, wherein said sheet guiding member is adapted to retract by rotating to a sheet stacking surface on said sheet stacking means.

19. The sheet receiving and stacking device according to claim 18, wherein said sheet guiding member comprises a support portion serving as a center of rotation, provided outside a region in which the sheet conveyed by said conveying means is conveyed in a direction of a width of the sheet, and pressing means for applying a pressing force onto said guiding member so that said guiding member is held in the guide position.

20. An image forming apparatus comprising:

image forming means for forming an image on a sheet;

a sheet conveying portion for conveying the sheet, on which the image is formed by the image forming means; and a sheet receiving and stacking device for receiving and stacking the sheet conveyed by the sheet conveying portion according to any one of claims 1 to 19.

21. The image forming apparatus according to claim 20, wherein said image forming means forms an image on a top surface of the sheet, and wherein the sheet having the top surface on which the image is formed by said image forming means, is stacked with the image-formed top face facing downward by conveying the sheet through said sheet conveying portion to said sheet receiving and stacking device placed under said image forming portion.

* * * * *